US005411021A

United States Patent [19]

Gdulla et al.

[11] Patent Number: 5,411,021

[45] Date of Patent: May 2, 1995

[54] BREATHING MASK WITH SPEAKING DEVICE

[75] Inventors: Manfred Gdulla; Rüdiger Müller; Thomas Neuber, all of Lübeck, Germany

[73] Assignee: Drägerwerk AG, Lübeck, Germany

[21] Appl. No.: 81,564

[22] Filed: Jun. 23, 1993

[30] Foreign Application Priority Data

Jun. 25, 1992 [DE] Germany ..... 42 20 780.0

[51] Int. Cl.[6] ..... A62B 18/02; A62B 23/02

[52] U.S. Cl. ..... 128/206.28; 128/206.21; 128/206.17

[58] Field of Search ..... 128/206.12, 206.16, 128/206.17, 206.21, 206.28, 207.12, 201.21, 201.22, 201.23, 201.24, 201.25, 201.28, 201.29, 202.15, 201.13, 201.15, 201.19

[56] References Cited

U.S. PATENT DOCUMENTS

| | | | |
|---|---|---|---|
| 3,602,219 | 8/1971 | Warncke . | |
| 4,111,197 | 9/1978 | Warncke et al. . | |
| 4,501,272 | 2/1985 | Shigematsu et al. | 128/206.15 |
| 4,764,990 | 8/1988 | Markert | 2/429 |
| 4,850,346 | 7/1989 | Michel et al. | 128/206.15 |
| 4,958,633 | 9/1990 | Angell | 128/201.19 |
| 4,961,420 | 10/1990 | Cappa et al. | 128/207.12 |
| 5,224,473 | 7/1993 | Bloomfield | 128/201.19 |

FOREIGN PATENT DOCUMENTS

| | | | |
|---|---|---|---|
| 115848 | 1/1930 | Austria | 128/207.12 |
| 649685 | 6/1964 | Belgium | 128/207.12 |
| 0238129 | 9/1987 | European Pat. Off. . | |
| 0329941 | 8/1989 | European Pat. Off. . | |
| 866231 | 4/1941 | France | 128/207.12 |
| 3211907 | 10/1983 | Germany . | |

*Primary Examiner*—Edgar S. Burr
*Assistant Examiner*—William J. Deane, Jr.
*Attorney, Agent, or Firm*—McGlew & Tuttle

[57] ABSTRACT

A breathing mask (1) with a chamber housing fastened in the mask body (2) for accommodating at least one breathing connection (4), an exhalation valve (6), and a speaking diaphragm are improved such that the chamber housing can be replaced in a simple manner. The circumferential surface of the chamber housing is provided with a plug-type connection piece (35), the mask body (2) has a support with a shape corresponding to the plug-type connection piece (35), and the plug-type connection piece (35) and the support are detachably connected via a locking member (40).

18 Claims, 2 Drawing Sheets

BREATHING MASK WITH SPEAKING DEVICE

FIELD OF THE INVENTION

The present invention pertains to a breathing mask with a chamber housing attached in the mask body between a mask interior and a mask exterior, in which at least one breathing connection, an exhalation valve, a speaking diaphragm above the exhalation valve, a holder carrying the breathing connection with a fresh air duct, and a connection chamber, defined by the speaking diaphragm and the exhalation valve, as well as the mask exterior are accommodated.

BACKGROUND OF THE INVENTION

A breathing mask of this class has become known from EP-A 329,941. The prior-art breathing mask has a chamber housing with a breathing connection, a speaking diaphragm, and an exhalation valve, wherein the speaking diaphragm is arranged in the chamber housing above the exhalation valve, and the exhaled air as well as the acoustic signals transmitted via the speaking diaphragm reach the exterior of the mask via a common connection chamber. A holder with the breathing connection is arranged in front of the exhalation valve, so that the exhaled air flows past the holder before it reaches the exterior of the mask. The holder is designed as a fresh air duct consisting of a hollow profile, through which the inhaled air reaches the interior of the mask body and then the interior of the inner mask from the breathing connection.

One disadvantage of the prior-art breathing mask is that the chamber housing is rigidly bound into the mask body with a fastening clip, which must be removed for cleaning the breathing mask.

Another disadvantage is that the chamber housing is arranged in the mouth area of the mask body, as a result of which the position of the center of gravity is unfavorable for the mask user, which reduces wear comfort, when the breathing filter is screwed on. If such a chamber housing is used in conjunction with a full-vision mask body, the breathing filter located in the mouth area also leads to a restricted field of vision.

A breathing mask that is also equipped with a speaking diaphragm and an exhalation valve has become known from EP-B 238,129. The prior-art breathing mask has, in the mouth area of the mask body, a chamber housing with a breathing connection, a speaking diaphragm, and an exhalation valve, wherein the speaking diaphragm and the exhalation valve are attached to a chamber wall within the chamber housing, and the exhaled air as well as the acoustic signals transmitted via the speaking diaphragm reach the exterior of the mask via a common connection chamber. For protection against moisture and contamination, the connection chamber is provided with a perforated cap. A breathing filter is connected to the underside of the chamber housing via a bellows-like adapter. The chamber housing as an essentially one-piece component is clipped into a mask body.

One disadvantage of the prior-art breathing mask is that the chamber housing is rigidly bound into the mask body with a fastening clip, which must be removed for cleaning the breathing mask.

Another disadvantage of the prior-art breathing mask is that even though the position of the center of gravity is improved by the lateral connection of the breathing filter, the breathing mask as a whole has even more unfavorable wear properties due to the flexibility of the bellows-like adapter. Another disadvantage is that liquid having penetrated into the connection chamber is unable to flow off directly to the exterior, but first collects below the exhalation valve. Even though provisions have been made to provide apertured diaphragms staggered relative to one another in order to make it difficult for liquid to penetrate into the connection chamber, effective drainage of the connection chamber is not achieved.

DE-A 32,11,907 discloses a device quick connection for breathing masks, with which a breathing mask with standardized threaded connection can be converted to a plug-type connection for device parts to be connected, e.g., a respirator.

SUMMARY AND OBJECTS OF THE INVENTION

The basic object of the present invention is to improve a breathing mask of the type described such that the chamber housing containing the breathing valves and the breathing connection can be replaced in a single manner.

This object is attained by the circumferential surface of the chamber housing being provided with a plug-type connection piece, by the mask body having a rigid support shaped correspondingly to the plug-type connection piece, and by the plug-type nipple and the support being detachably connected via a locking member means.

The advantage of the present invention is essentially the fact that the chamber housing can be fastened in the mask body without the use of a tool by providing the circumferential surface of the chamber housing with a plug-type connection piece, which is plugged into the support on the mask body, wherein the plug-type connection piece and the support are detachably connected via the locking member means. It is thus possible to take apart the breathing mask for cleaning in a simple manner by pushing the module-like chamber housing out of the support in the direction of the mask interior; however, a chamber housing with defective directional valves can also be rapidly replaced even during the use of the device, without having to replace the entire breathing mask, which is usually individually assigned to certain users. The locking member means is preferably made of an elastic material, e.g., an elastomer, as a result of which positive-locking connection is achieved between the plug-type connection piece and the support. An alternative embodiment of the chamber housing consists of the chamber housing being equipped with a respirator. It is thus possible to perform respiration via a breathing filter or a respirator with a mask body by using the respective chamber housing.

Advantageous embodiments of the present invention are described in the subclaims.

It is advantageous to make the mask body of a solid material, which may also be completely transparent, and to make the support directly in one piece with the mask body as a pot-like part, e.g., by folding over the mask body to the exterior of the mask. A projection, which is used as a stop for the chamber housing, is provided on the support.

The plug-type connection piece preferably has in a depression a sealing ring acting as a locking member, by which the plug-type connection piece is detachably held in the support.

In another advantageous embodiment, a seating ring is arranged in a depression on the plug-type connection piece, and a clasp with two flexible legs is used as the locking member means, wherein the legs engage locking grooves on the plug-type connection piece via openings in the support. The clasp can be pushed over the support, and it brings about a detachable connection between the support and the plug-type connection piece. To remove the chamber housing from the mask body, the clasp is pulled off the support, and the plug-type connection piece is then removed from the support.

According to one advantageous embodiment of the prevent invention, the support of the breathing connection is arranged on the chamber housing opposite the speaking diaphragm, as a result of which the chamber housing can be fastened to the mask body in the chin area of the breathing mask. As a result, the field of vision of the breathing mask is enlarged, and the location of the center of gravity of the breathing mask is also improved by the breathing filter being arranged in the chin area of the breathing mask.

It is advantageous to design the diaphragm chamber in contact with the speaking diaphragm such that a speaking opening is present above the holder, and a drainage opening is present under the holder, wherein the drainage opening opens into the exhalation chamber, or it leads directly to the exterior of the mask. Liquid that may have penetrated through the speaking opening is thus able to flow out of the diaphragm chamber through the drainage opening, and efficient drainage of the diaphragm chamber is achieved. The liquid is kept away from the exhalation valve due to the drainage opening being arranged above the exhalation valve.

The part of the chamber wall supporting the speaking diaphragm is preferably bent in relation to the holder such that the diaphragm chamber has a downwardly tapering cross-sectional contour, and the drainage opening is arranged at the wedge tip of the diaphragm chamber. Complete drainage is possible due to the wedge-shaped design of the diaphragm chamber, because liquid that has entered from the outside always collects in the area of the tip of the wedge.

The chamber housing is preferably provided, toward the outside of the mask, with a cap as part of the chamber housing, which has openings in the area of the speaking opening of the breathing connection and of the exhalation valve.

It is advantageous to provide a drainage outlet at the lowest point of the cap.

It is advantageous to provide a fastening means on the chamber housing for mounting an inner mask. In the simplest case, the fastening means is a circumferential groove on the chamber housing, into which a bead located on the inner mask is buttoned.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
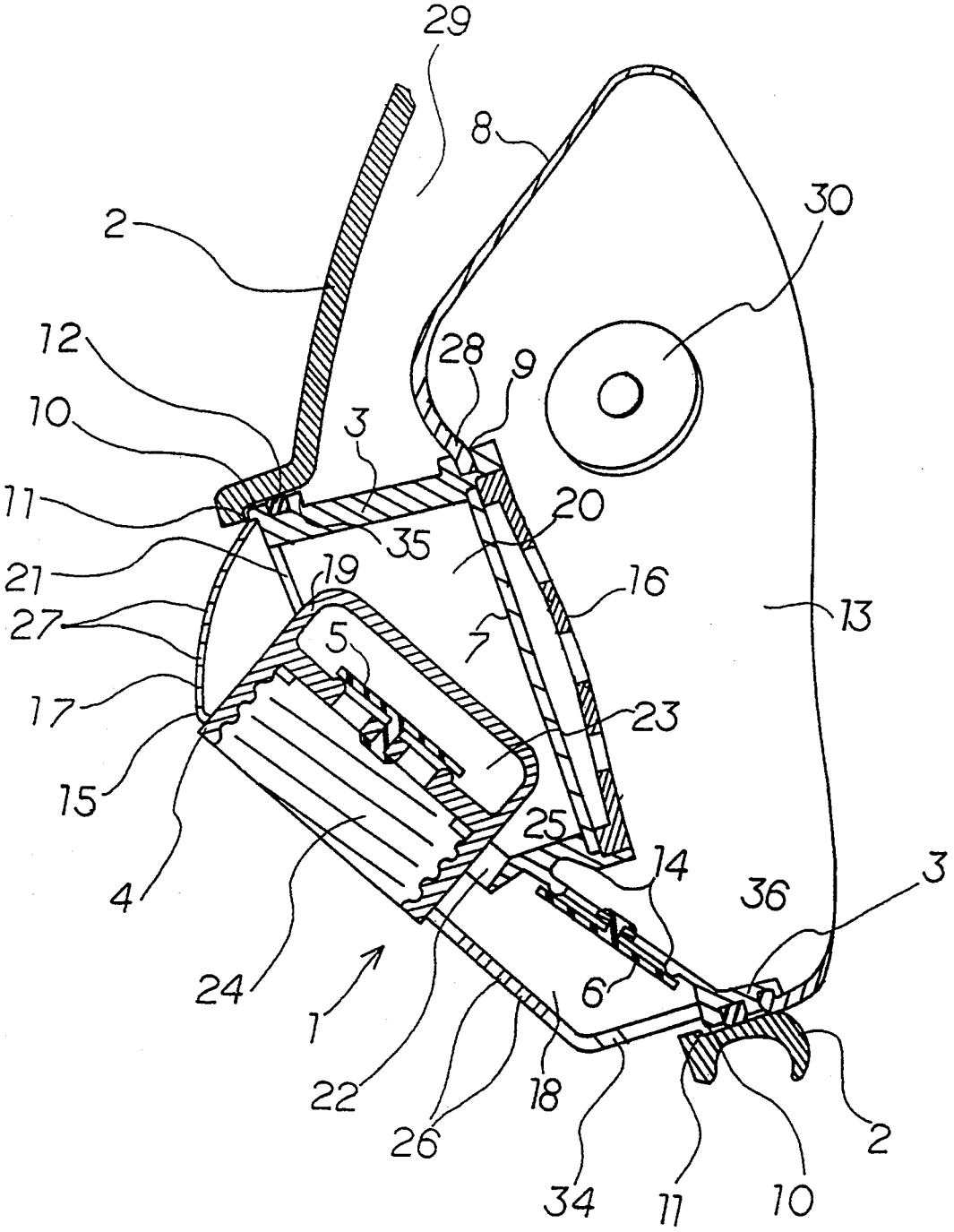
FIG. 1 is a sectional view of a chamber housing of a breathing mask.

FIG. 1 shows the partial sectional view of a breathing mask 1, which has a solid mask body 2, into which a module-like chamber housing 3 with a breathing connection 4, an inhalation valve 5, an exhalation valve 6, and a speaking diaphragm 7 is inserted. The chamber housing 3 includes a connection chamber defined by the speaking diaphragm 7 and the exhalation valve 6 as well as by an exterior of the breathing mask 1. An inner mask 8, whose sectional view is also shown in FIG. 1, is buttoned into a circumferential groove 9 on the chamber housing 3 by means of a bead 28. The inner mask encloses a mask interior 13. The mask body 2 encloses a mask body interior 29, and is illustrated in FIG. 1 only as a cutout. The mask body 2 has a rigid support or receptacle 10 shaped as a pot-like part into which the chamber housing 3 can be pushed from the mask body interior 29. The chamber housing 3 is provided with a plug-type connection piece 35. A projection 11 at the support 10 is used as a stop for the chamber housing 3. The sealing between the support 10 of the mask body 2 and the chamber housing 3 is ensured by a sealing ring 12 extending around the plug-type connection piece 35 of the chamber housing 3 in a recess 36.

The speaking diaphragm 7 and the exhalation valve 6 are arranged in a chamber wall 14, which is the separating surface between the mask interior 13 and the mask exterior 15. The speaking diaphragm 7 is attached to the chamber wall 14 with a diaphragm cover 16, and is directed toward the mouth of the mask user, not shown in FIG. 1. The exhalation valve 6 is located below the speaking diaphragm 7. Toward the mask exterior 15, the chamber housing 3 is provided with a cap 17, which is part of the chamber housing 3 and can be attached to the chamber housing 3, and has openings 26, 27 and a drainage outlet 34.

A holder 19 is located in front of the speaking diaphragm 7, as a result of which a diaphragm chamber 20 is formed, which is in flow connection with the mask exterior 15 via a speaking opening 21, and a drain opening 22 connected to an exhalation chamber 18. The exhalation chamber 18 is located under the diaphragm chamber 20, contains the exhalation valve 6, and is in flow connection with the mask exterior 15 via the first perforations 26 in the cap 17.

Toward the mask exterior 15, the breathing connection 4 is attached to the holder 19 with a round thread 24 for inserting a breathing filter, not shown in FIG. 1. The breathing connection 4 is in flow connection with the mask body interior 29 via the inhalation valve 5 and a fresh air duct 23, and the fresh air duct 23 is located within the holder 19. The breathing gas enters the mask interior 13 from the mask body interior 29 via a directional valve 30. The diaphragm chamber 20 has an essentially wedge-shaped cross-sectional contour, and the drain opening 22 is located at the wedge tip 25 of the diaphragm chamber 20.

Figure 2:
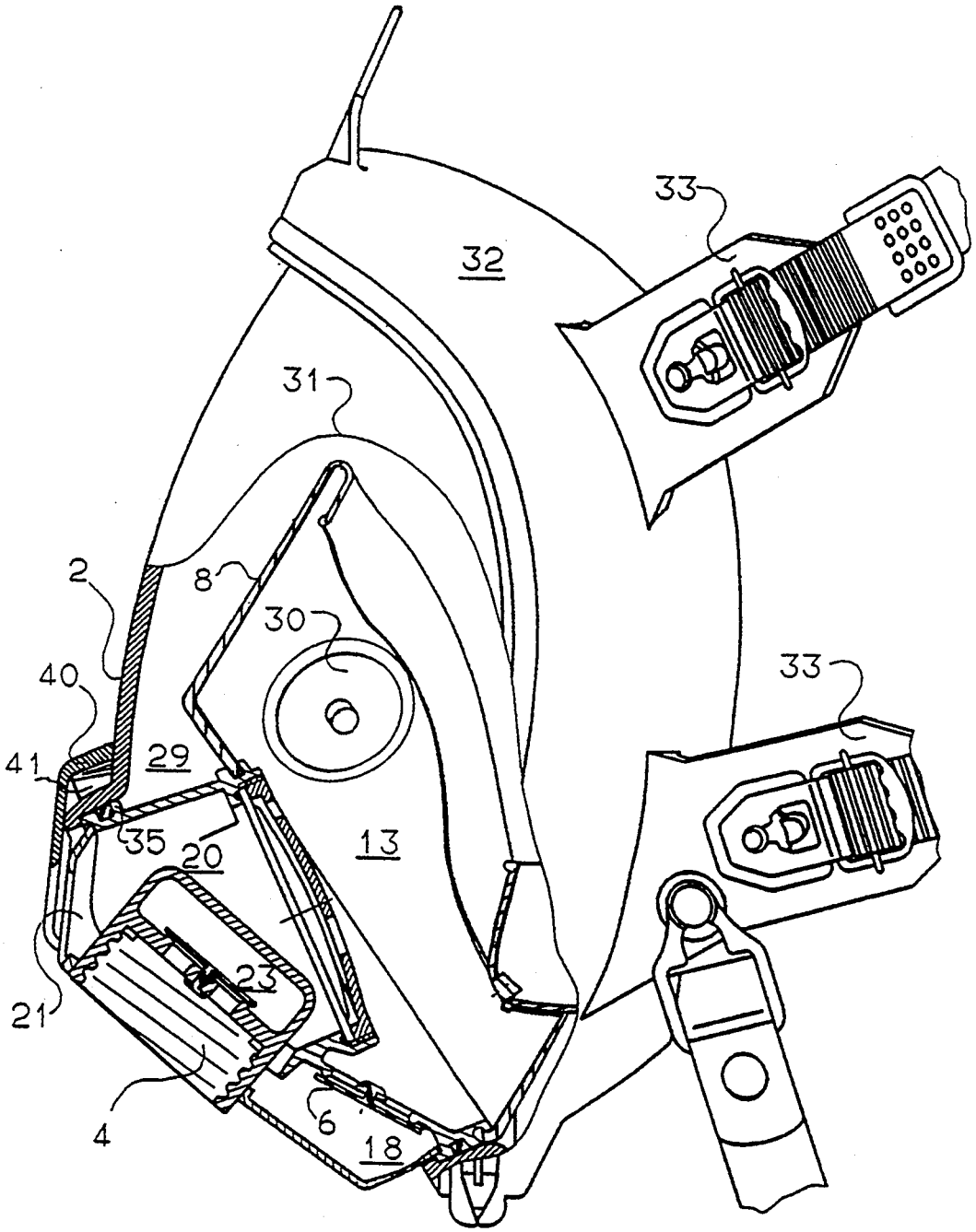
FIG. 2 is a partially sectional view showing the arrangement of the chamber housing in a breathing mask.

FIG. 2 shows the arrangement of the chamber housing 3 in the chin area of the mask body 2 of a the breathing mask 1. The mask body 2 is cut open along the line 31. Identical components are designated by the same reference numerals as in FIG. 1. An elastic sealing edge 32 with a strap 33 is arranged on the mask body 2 for placing the breathing mask 1 on the face of a mask user, not shown in FIG. 2. The locking member means includes a clasp 40, which is pushed over the support 10 and has two flexible legs or snap-in member means 41, only one of which is partially recognizable in FIG. 2, is provided for detachably fastening the plug-type connection piece 35 within the support 10 (FIG. 1). Through openings (not shown in FIG. 2) in the support 10, the legs 41 are able to engage locking grooves (likewise not shown) on the plug-type connection piece 35, as a result of which the plug-type connection piece 35 is fixed relative to the support 10.

The mode of operation of the breathing mask 1 according to the present invention is as follows: During inhalation, the breathing gas flows through the breathing connection 4, the inhalation valve 5, the fresh air duct 23, and the mask body interior 29 into the mask interior 13, and the exhaled breathing gas flows to the mask exterior 15 through the exhalation valve 6 and the individual first openings 26 in the cap 17. During speaking, the acoustic signals emitted by the speaking diaphragm 7 reach the mask exterior 15 through the speaking opening 21 and the second openings 27 in the cap 17. If liquid reaches the diaphragm chamber 20 via the second perforations 27, this liquid is able to flow off through the drain opening 22, past the exhalation valve 6, and the drainage outlet 34 provided in the cap 17.

To clean the breathing mask 1, the clasp 40 is pulled off, and the chamber housing 3 is pushed out of the support 10 in the mask body 2 toward the mask body interior 29, the inner mask 8 is unbuttoned from the groove 9, the cap 17 is pulled off the chamber housing 3, and the speaking diaphragm 7 is removed by detaching the diaphragm cover 16.

While a specific embodiment of the invention has been shown and described in detail to illustrate the application of the principles of the invention, it will be understood that the invention may be embodied otherwise without departing from such principles.

What is claimed is:

1. A breathing mask, comprising:

a mask body defining a mask interior and a mask exterior, the mask body defining an opening with a shaped fixed support;

a chamber housing fastened to said mask body, said chamber housing being provided with a plug-type connection piece, said shaped fixed support corresponding to said plug-type connection piece, said chamber housing having accommodated therein at least one breathing connection, an exhalation valve, a speaking diaphragm above the exhalation valve, a holder carrying the breathing connection with a fresh air duct, and a connection chamber defined by the speaking diaphragm and the exhalation valve, as well as by the mask exterior; and snap-in member means for detachably connecting said plug-type connection piece to said shaped fixed support.

2. A breathing mask according to claim 1, wherein:

said mask body is formed of a solid material, said shaped fixed support being made in one piece with said mask body as a pot-like part, said shaped fixed supported having a projection forming a stop for said plug-type connection piece.

3. A breathing mask according to claim 1, wherein:

said plug-type connection piece forms a depression, said snap-in member means including a sealing ring positioned in said depression by which said plug-type connection piece is detachably held in said shaped fixed support.

4. A breathing mask according to claim 2, wherein:

said plug-type connection piece forms a depression, said snap-in member means including a sealing ring positioned in said depression by which said plug-type connection piece is detachably held in said shaped fixed support.

5. A breathing mask according to claim 1, wherein:

said plug-type connection piece includes a depression, said snap-in member means including a sealing ring positioned in said depression and a clasp, which can be pushed over said support and which includes flexible legs, said legs engaging locking grooves on said plug-type connection piece through openings of said support.

6. A breathing mask according to claim 2, wherein:

said plug-type connection piece includes a depression, said snap-in member means including a sealing ring positioned in said depression and a clasp, which can be pushed over said support and which includes flexible legs, said legs engaging locking grooves on said plug-type connection piece through openings of said support.

7. A breathing mask according to claim 1, wherein:

said holder carrying the breathing connection is arranged in said chamber housing in front of said speaking diaphragm such that said connection chamber is divided into a diaphragm chamber that at least partially surrounds said speaking diaphragm and an exhalation chamber at said exhalation valve.

8. A breathing mask according to claim 7, wherein:

said diaphragm chamber has a speaking opening directed toward said mask exterior above said holder, a drain opening being formed opening into said exhalation chamber or directly to said mask exterior.

9. A breathing mask according to claim 7, wherein:

said speaking diaphragm is bent relative to said holder such that said diaphragm chamber has a downwardly tapering, wedge-shaped cross sectional contour, said drain opening being arranged at a wedged tip of said diaphragm chamber.

10. A breathing mask according to claim 8, wherein:

said speaking diaphragm is bent relative to said holder such that a diaphragm chamber has a downwardly tapering, wedge-shaped cross sectional contour, said drain opening being arranged at a wedged tip of said diaphragm chamber.

11. A breathing mask according to claim 8, wherein:

said chamber housing is provided with a cap covering said connection chamber toward said mask exterior, said cap being attached to said chamber housing, said cap having openings at least in an area of said speaking opening and said exhalation valve.

12. A breathing mask according to claim 11, wherein:

said cap has a drainage outlet provided under said exhalation valve.

13. A breathing mask according to claim 1, wherein:

said chamber housing has a groove for attaching an inner mask.

14. A breathing mask, comprising:

a mask body;

a chamber housing fastened in the mask body between the mask interior space and the mask outside, said chamber housing accommodating a breathing connection and an expiration valve, said chamber housing having a circumferential surface being provided with a plug-type connection piece, said mask body having a support, a surface of said support being shaped correspondingly to said plug-type connection piece;

snap-in member means for detachably connecting said plug-type connection piece to said support.

15. A breathing mask, comprising:

a mask body, including a receptacle;

a chamber housing fastened in the mask body between the mask interior space and the mask outside, said chamber housing accommodating a breathing connection and an expiration valve, said chamber housing having a circumferential surface with a plug-type connection piece plugable into said receptacle, said receptacle of said mask body being shaped correspondingly to said plug-type connection piece;

snap-in member means for locking said plug-type connection piece to said receptacle.

16. A device in accordance with claim 15, wherein:

said chamber housing including a speaker diaphragm positioned above said expiration valve and substantially opposite said breathing connection, said chamber housing being fastened in a chin area of said mask body.

17. A device in accordance with claim 15, wherein:

said snap-in member means includes flexible legs engaging with locking grooves on said plug-type connection piece through openings of said receptacle.

18. A device in accordance with claim 16, wherein:

said breathing connection is slanted with respect to said speaking diaphragm to define a wedge-shaped diaphragm chamber with a speaking opening on one side of said respiration connection and a drainage opening on another side of said respiration connection, said chamber housing being fastened in a chin area of said mask body.

* * * * *